US009597605B1

(12) United States Patent
Chung et al.

(10) Patent No.: US 9,597,605 B1
(45) Date of Patent: Mar. 21, 2017

(54) ANIMATRONIC DOLL

(71) Applicants: Caleb Chung, Boise, ID (US); Leonard Byron Levitt, Garden City, ID (US)

(72) Inventors: Caleb Chung, Boise, ID (US); Leonard Byron Levitt, Garden City, ID (US)

(73) Assignees: IT'S ALIVE LABS, LLC, Boise, ID (US); EAST WEST INNOVATION, LLC, Seal Beach, CA (US)

( * ) Notice: Subject to any disclaimer, the term of this patent is extended or adjusted under 35 U.S.C. 154(b) by 0 days.

(21) Appl. No.: 15/225,659

(22) Filed: Aug. 1, 2016

(51) Int. Cl.

| | |
|---|---|
| ***A63H 3/00*** | (2006.01) |
| ***A63H 31/00*** | (2006.01) |
| ***A63H 13/02*** | (2006.01) |
| ***A63H 3/40*** | (2006.01) |
| ***A63H 3/46*** | (2006.01) |
| ***A63H 13/00*** | (2006.01) |

(52) U.S. Cl.
CPC ..... *A63H 13/02* (2013.01); *A63H 3/00* (2013.01); *A63H 3/40* (2013.01); *A63H 3/46* (2013.01); *A63H 13/005* (2013.01); *A63H 31/00* (2013.01)

(58) Field of Classification Search
CPC ... A63H 3/00; A63H 3/20; A63H 3/36; A63H 3/40; A63H 3/46; A63H 31/00; A63H 31/04; A63H 31/08; A63H 11/00; A63H 13/00; A63H 13/005; A63H 13/02; A63H 29/02; A63H 29/04; A63H 29/06; A63H 29/22
See application file for complete search history.

(56) References Cited

U.S. PATENT DOCUMENTS

| | | | | | |
|---|---|---|---|---|---|
| 1,576,789 | A * | 3/1926 | Robertson | A63H 3/48 | 273/161 |
| 3,147,566 | A * | 9/1964 | Ong | A63H 3/18 | 446/359 |
| 3,475,853 | A * | 11/1969 | Adler | A63H 3/20 | 446/330 |
| 4,003,158 | A * | 1/1977 | Wolf | A63H 13/06 | 446/334 |
| 4,968,280 | A * | 11/1990 | Kelley | A63H 3/20 | 446/330 |
| 5,695,382 | A * | 12/1997 | Lin | A63H 13/00 | 40/418 |
| 6,093,078 | A * | 7/2000 | Cook | A63H 3/20 | 446/330 |

(Continued)

*Primary Examiner* — Gene Kim
*Assistant Examiner* — Alyssa Hylinski
(74) *Attorney, Agent, or Firm* — Parsons Behle & Latimer

(57) ABSTRACT

An animatronic doll having a motor, a head frame pivotally mounted to a neck carrier, a bevel gear and a pinion gear connected to a head shaft, a first gear, and a second gear. The pinion gear is engaged with a rack of the head frame. The first gear is configured to be driven by the bevel gear and is rotatable between a first position, a second position, and a third position. The first gear does not drive the second gear when the first gear is rotated between the first position and the second position. The first gear drives the second gear when the first gear is rotated between the second position and the third position. Rotation of the head shaft rotates the pinion gear and pivots the head frame. Rotation of the second gear may rotate arms of the doll. The arms may include friction clutches.

20 Claims, 12 Drawing Sheets

(56) References Cited

U.S. PATENT DOCUMENTS

| | | | | |
|---|---|---|---|---|
| 6,416,380 | B1 * | 7/2002 | Li-Wen | A63H 3/20 446/330 |
| 6,503,123 | B2 | 1/2003 | Chung | |
| 6,902,048 | B1 * | 6/2005 | Chung | F16D 19/00 192/48.2 |
| 7,942,720 | B1 * | 5/2011 | Galoustian | A63H 3/02 446/297 |
| 8,662,955 | B1 * | 3/2014 | Fai | A63H 13/005 446/268 |
| 8,784,154 | B2 * | 7/2014 | Chuang | A63H 3/20 446/354 |
| 2002/0077023 | A1 * | 6/2002 | Marine | A63H 3/48 446/330 |
| 2003/0047017 | A1 * | 3/2003 | Liu | A63H 29/22 74/421 A |
| 2009/0215358 | A1 * | 8/2009 | Moothedath | A63H 3/46 446/139 |
| 2010/0216370 | A1 * | 8/2010 | Hoeting | A63H 13/02 446/355 |

* cited by examiner

ANIMATRONIC DOLL

FIELD OF THE DISCLOSURE

The embodiments described herein relate to an animatronic doll. More specifically, the embodiments described herein relate to a mechanism for moving parts of an animatronic doll.

BACKGROUND

Description of the Related Art

Animatronic dolls are growing in popularity and may incorporate complex motor and gear sets to simulate movement. In some known dolls, separate motors are utilized for each limb. In some known dolls, multiple motors are used to move the same limb, such as extending and retracting an arm. Furthermore, animatronic mechanisms may increase the costs associated with dolls and decrease their durability. Some known animatronic mechanisms may be ill-suited for rough handling, such as by children playing with toys. Additionally, in the toy industry, consumers may be more reactive to price increases than other industries and thus, technologies may be excluded from products in the toy industry until they have been adapted in such a way as to be more cost effective. Moreover, known dolls may incorporate pulleys, cables, and other components that make it difficult to determine the position of a portion of the doll.

SUMMARY

The present disclosure is directed to a system that overcomes some of the problems and disadvantages discussed above.

One embodiment is an animatronic doll comprising a head frame, a neck carrier, a head shaft, a bevel gear, a pinion gear, a first gear, a second gear, and a motor. The head frame includes a rack and is pivotally mounted to the neck carrier. The head shaft has a first end and a second end, the second end being closer to the head frame than the first end. The bevel gear is connected to the head shaft. The pinion gear is connected to the head shaft at the second end and is engaged with the rack of the head frame. The first gear is rotatably mounted about a first axis of rotation and includes a driver portion and a bevel portion. The bevel portion of the first gear is engaged with the bevel gear. The first gear has a first position, a second position, and a third position. The second gear is rotatably mounted about a second axis of rotation. The second gear has a follower portion, wherein rotation of the first gear between the first position and the second position does not rotate the second gear and, wherein rotation of the first gear between the second position and the third position rotates the second gear. The motor is configured to rotationally drive the bevel gear and the head shaft.

The driver portion of the first gear may comprise a base, a protrusion, and a plurality of teeth extending radially from the protrusion. The bevel portion may be disposed on a side of the base. The protrusion may extend from the base opposite the bevel portion. The plurality of teeth may include a first end tooth and a second end tooth with a gap therebetween. The follower portion of the second gear may comprise a base, a protrusion extending from the base, and a plurality of teeth extending radially from the protrusion. The plurality of teeth may include a first end tooth and a second end tooth with a gap therebetween.

The base of the first gear may have a first radius from the first axis of rotation and the base of the second gear may have a second radius from the second axis of rotation. The distance between the first axis of rotation and the second axis of rotation may be less than the sum of the first radius and the second radius. The base of the second gear may include a cutout having a radius equal to the first radius. The base of the second gear may be crescent shaped.

The doll may include an arm shaft, a left friction clutch, a right friction clutch, a left arm, and a right arm. The arm shaft may have a first end and a second end with the second gear being connected to the arm shaft between the first end and the second end. The left friction clutch may have a friction disk and a slide washer. The friction disk of the left friction clutch may be connected to the first end of the arm shaft. The right friction clutch may have a friction disk and a slide washer. The friction disk of the right friction clutch may be connected to the second end of the arm shaft. The left arm is connected to the slide washer of the left friction clutch and the right arm connected to the slide washer of the right friction clutch.

The doll may include a torsion spring connecting the rack to a portion of the head frame. The doll may include a compound gear and a drive gear connected to the motor. The compound gear may be comprised of the bevel gear and a spur gear engaged with the drive gear. The neck carrier may include a ring gear disposed on a bottom of the neck carrier. The doll may include a neck motor connected to a neck drive gear, wherein rotation of the neck drive gear rotates the neck carrier.

One embodiment is a method of operating an animatronic doll comprising actuating a motor to rotate a compound gear. The compound gear includes at least a bevel gear. The method includes rotating a head shaft connected to the compound gear, rotating a pinion gear connected to the head shaft, and pivoting a head frame having a rack, the rack engaging the rotating pinion gear. The method includes rotating a first gear a first extent from a first position to a second position. The first gear has a bevel portion engaged with the bevel gear and has a driver portion positioned adjacent a follower portion of a second gear. The driver portion does not engage the follower portion of a second gear during the first extent of rotation. The method includes rotating the first gear a second extent from the second position to a third position. The driver portion engages the follower portion of a second gear during the second extent of rotation and rotates the follower portion of the second gear.

The method may include pivoting the head frame at a slower rate than the follower portion of the second gear during the second extent of rotation. The second extent of rotation may be more than 120 degrees.

The second gear may be connected to an arm shaft such that the arm shaft rotates with the second gear. The arm shaft is connected to a right arm and a left arm. The rack may be connected to a portion of the head frame through a torsion spring. The motor may include a drive gear and the compound gear may include a spur gear. The drive gear engages the spur gear of the compound gear, wherein the head shaft is rotated through its connection to the compound gear.

One embodiment is an animatronic doll comprising a head frame having a rack, a neck carrier, a bevel gear, a first gear, and a second gear. The head frame is pivotally mounted to the neck carrier. The bevel gear is connected to a head shaft. The first gear is configured to be driven by the bevel gear and is rotatable between a first position, a second position, and a third position. The second gear is positioned adjacent the first gear. The first gear drives the second gear when the first gear is rotated between the second position and the third position. Rotation of the head shaft rotates a pinion gear engaged with the rack of the head frame. Rotation of the bevel gear rotates the first gear.

The extent of rotation between the second position and the third position may be more than 120 degrees. The neck carrier may include a ring gear disposed on a bottom of the neck carrier. The doll may include a neck motor connected to a neck drive gear, wherein rotation of the neck drive gear rotates the neck carrier.

The first gear may comprise a base, a protrusion extending from the base, and a plurality of teeth extending radially from the protrusion. The bevel portion may be disposed on a side of the base. The plurality of teeth may include a first end tooth and a second end tooth with a gap therebetween. The follower portion of the second gear may comprise a base, a protrusion extending from the base, and a plurality of teeth extending radially from the protrusion. The plurality of teeth may include a first end tooth and a second end tooth with a gap therebetween.

The doll may include an arm shaft, a left friction clutch, a right friction clutch, a left arm, and a right arm. The arm shaft may have a first end and a second end with the second gear being connected to the arm shaft between the first end and the second end. The left friction clutch may have a friction disk and a slide washer. The friction disk of the left friction clutch may be connected to the first end of the arm shaft. The right friction clutch may have a friction disk and a slide washer. The friction disk of the right friction clutch may be connected to the second end of the arm shaft. The left arm is connected to the slide washer of the left friction clutch and the right arm connected to the slide washer of the right friction clutch.

Figure 1:
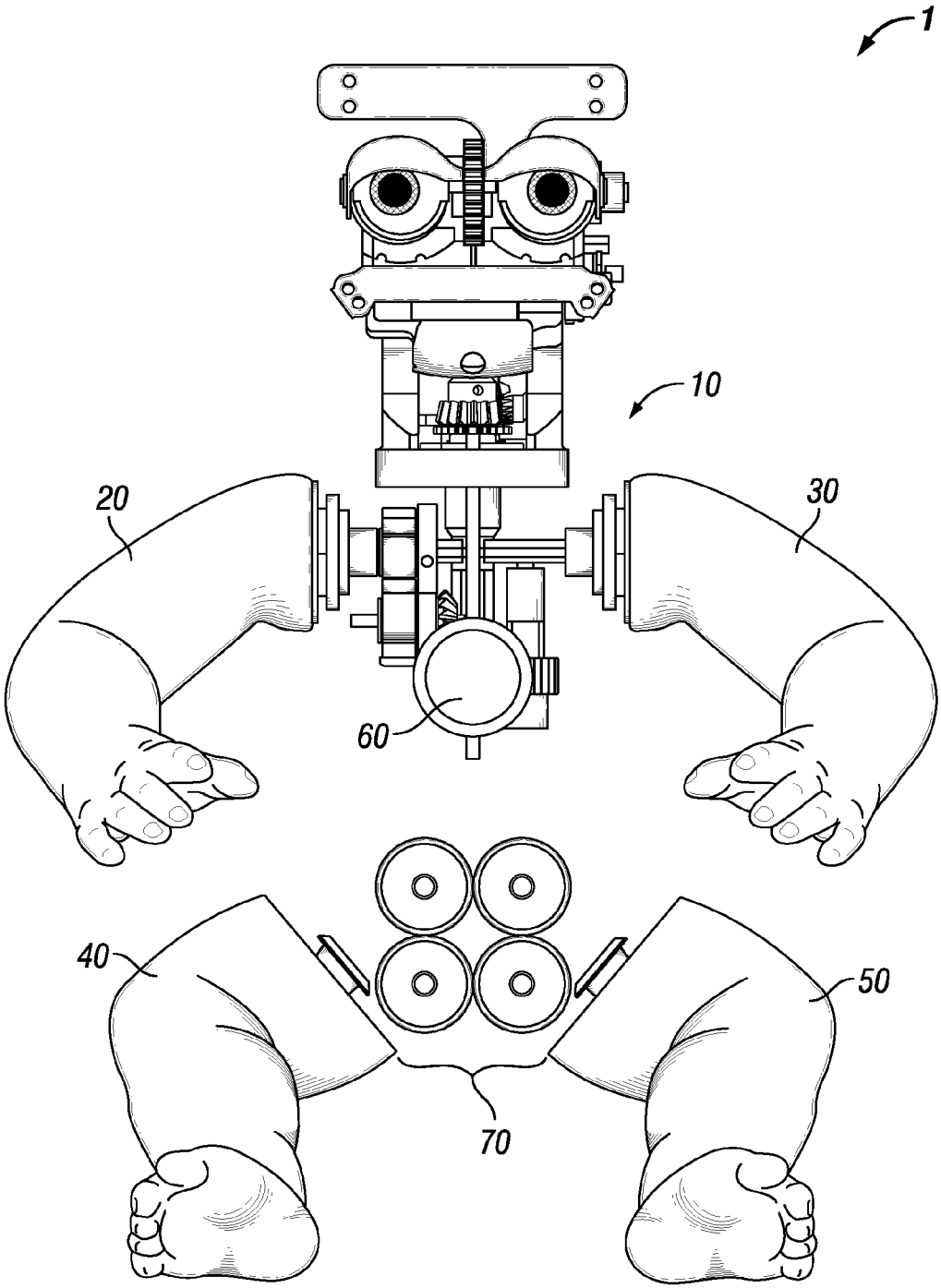
FIG. 1 shows an embodiment of an animatronic doll without an external appearance shell.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows an animatronic doll 1 without an external appearance shell. The external appearance shell may give the appearance of a baby. Doll 1 includes a drive mechanism 10, a right arm 20, a left arm 30, a right leg 40, a left leg 50, a speaker 60, and a power source 70. Speaker 60 is configured to emit preselected sounds from a command module (not shown). The preselected sounds may be coordinated with movement of body parts of doll 1. Drive mechanism 10 controls movement of right arm 20, left arm 30, and a head section of doll 1 as will be apparent from the discussion herein. Right arm 20 and left arm 30 may include joints. The joints may be positioned in the shoulders and in the elbows.

Figure 2:
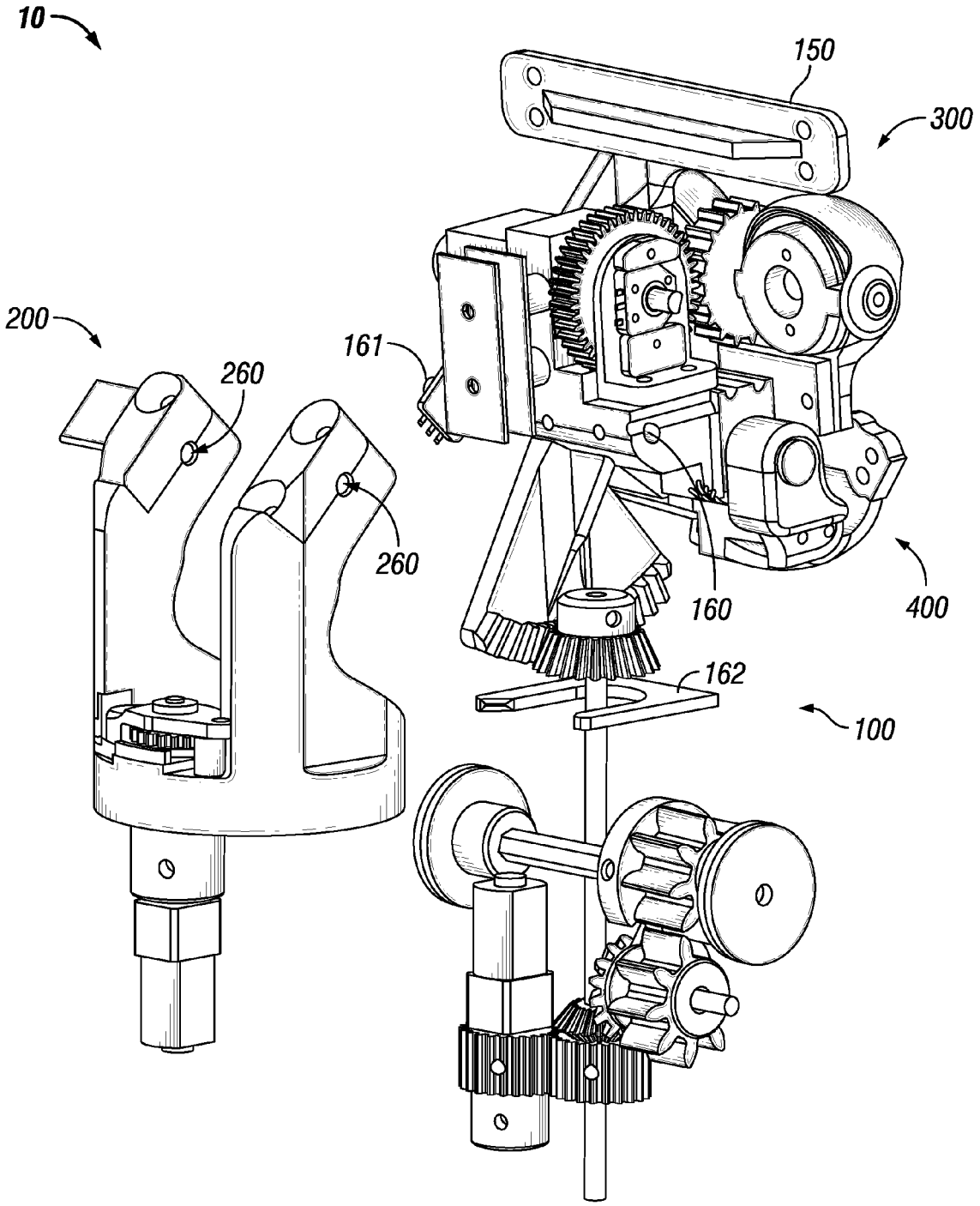
FIG. 2 shows an exploded view of an embodiment of a drive mechanism including a body assembly, a neck assembly, an eye assembly, and a mouth assembly.

FIG. 2 shows an exploded view of an embodiment of a drive mechanism 10 including a body assembly 100, a neck assembly 200, an eye assembly 300, and a mouth assembly 400. The eye assembly 300 and mouth assembly 400 are mounted upon a head frame 150 of body assembly 100. Neck assembly 200 includes pivot points 260 that are pivotally connected to a pivot point 160 of head frame 150 of body assembly 100. A through hole potentiometer 161 may measure rotational displacement of head frame 150 about pivot point 160. A clip 162 may be received by neck assembly 200 and secure neck assembly 200 to the external appearance shell (not shown).

Figure 3:
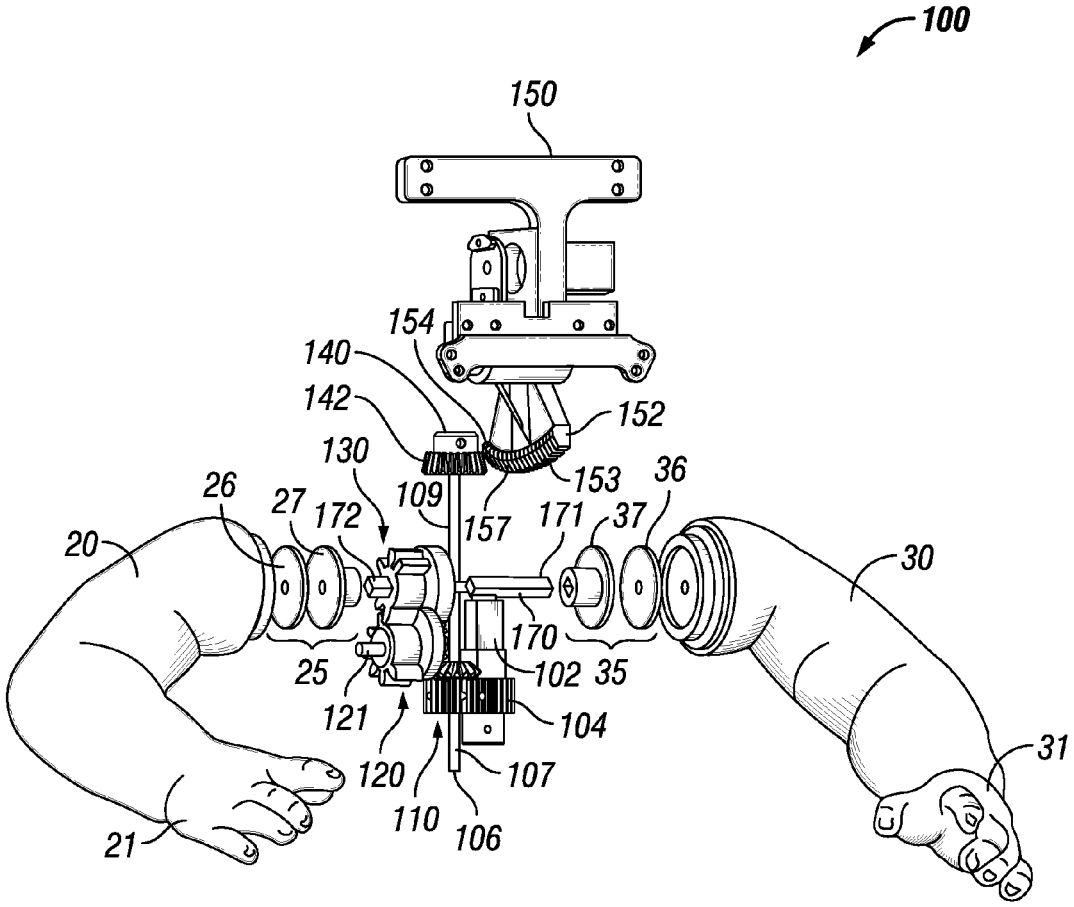
FIG. 3 shows an exploded view of an embodiment of a body assembly connected to a right arm via a right friction clutch and connected to a left arm via a left friction clutch.

FIG. 3 shows an exploded view of body assembly 100 connected to right arm 20 via a right friction clutch 25 and connected to left arm 30 via a left friction clutch 35. Right friction clutch 25 includes a slide washer 26 and a friction disk 27. Slide washer 26 is rigidly connected to right arm 20. Body assembly 100 includes an arm shaft 170 having a first end 171 and a second end 172. Friction disk 27 is connected to arm shaft 170 at second end 172. Slide washer 26 and friction disk 27 are mounted under compression so that a surface of slide washer 26 presses against a surface of friction disk 27. As arm shaft 170 rotates, it causes friction disk 27 to rotate with arm shaft 170. The compressive force between friction disk 27 and slide washer 26 transfers the rotational motion of friction disk 27 into slide washer 26 and causes slide washer 26 to rotate with friction disk 27. Right arm 20 is rotated with slide washer 26 through the rigid connection thereto. In operation, right arm 20 may be subject to an outside force, such as a child moving the placement of right arm 20. The outside force applied to right arm 20 causes slide washer 26 to rotate with respect to friction disk 27, resulting in a rotational misalignment of slide washer 26 with respect to friction disk 27. As the outside force is applied, the surface of slide washer 26 and the surface of friction disk 27 slide with respect to one another, allowing movement of slide washer 26 with respect to friction disk 27. During application of the outside force, friction disk 27 may be held stationary, rotate at a different rate than slide washer 26, or rotate in a different direction than slide washer 26, depending on the operation of motor 102, as discussed below.

Stops (not shown) may be positioned on right friction clutch 25 or within body assembly 100 to limit the range of motion of right arm 20. For example, an upper stop may limit movement of right arm 20 so that hand 21 is adjacent to an ear (not shown) on the head frame 150. A lower stop may limit movement of right arm 20 so that hand 21 is placed in a lap of the doll or to the doll's sides. In operation, friction disk 27 may be rotated by arm shaft 170 and cause right arm 20 to rotate until a stop is reached. The stop inhibits further rotation of right arm 20 and thereby slide washer 26 rigidly connected to right arm 20. Friction disk 27 continues to rotate as the surface of slide washer 26 and the surface of friction disk 27 slide against each other. Once the rotation of friction disk 27 is reversed, the compressive force between friction disk 27 and slide washer 26 transfers the rotation motion into slide washer 26 and rotates friction disk 27 and slide washer 26 together. If friction disk 27 is rotated to sufficiently far toward the misaligned right arm 20, right arm 20 may be in correct alignment with respect to friction disk 27.

Left friction clutch 35 includes a slide washer 36 and a friction disk 37. Slide washer 36 is rigidly connected to left arm 30. Friction disk 37 is connected to arm shaft 170 at first end 171. Slide washer 36 and friction disk 37 are mounted under compression so that a surface of slide washer 36 presses against a surface of friction disk 37. As arm shaft 170 rotates, it causes friction disk 37 to rotate with arm shaft 170. The compressive force between friction disk 37 and slide washer 36 transfers the rotational motion of friction disk 37 into slide washer 36 and causes slide washer 36 to rotate with friction disk 37. Left arm 30 is rotated with slide washer 36 through the rigid connection thereto. In operation, left arm 30 may be subject to an outside force, such as a child moving the placement of left arm 30. The outside force applied to left arm 30 causes slide washer 36 to rotate with respect to friction disk 37, resulting in a rotational misalignment of slide washer 36 with respect to friction disk 37. As the outside force is applied, the surface of slide washer 36 and the surface of friction disk 37 slide with respect to one another, allowing movement of slide washer 36 with respect to friction disk 37. During application of the outside force, friction disk 37 may be held stationary, rotate at a different rate than slide washer 36, or rotate in a different direction than slide washer 36, depending on the operation of motor 102, as discussed below.

Stops (not shown) may be positioned on left friction clutch 35 or within body assembly 100 to limit the range of motion of left arm 30. For example, an upper stop may limit movement of left arm 30 so that hand 31 is adjacent to an ear (not shown) on the head frame 150. A lower stop may limit movement of left arm 30 so that hand 31 is placed in a lap of the doll or to the doll's sides. In operation, friction disk 37 may be rotated by arm shaft 170 and cause left arm 30 to rotate until a stop is reached. The stop inhibits further rotation of left arm 30 and thereby slide washer 36 rigidly connected to left arm 30. Friction disk 37 continues to rotate as the surface of slide washer 36 and the surface of friction disk 37 slide against each other. Once the rotation of friction disk 37 is reversed, the compressive force between friction disk 37 and slide washer 36 transfers the rotation motion into slide washer 36 and rotates friction disk 37 and slide washer 36 together. If friction disk 37 is rotated sufficiently far toward the misaligned left arm 30, left arm 30 may be in correct alignment with respect to friction disk 37.

Body assembly 100 includes a motor 102 driving a split drive gear assembly. The split drive gear assembly includes a first drive path and a second drive path. The gear assembly may include a drive gear 104. The gear assembly includes a compound gear 110, a geneva pair (comprised of geneva driver 120 and geneva follower 130), and a pinion gear 140. Compound gear 110 is rigidly connected to a head shaft 106 toward a first end 107 (best shown in FIG. 5) so that rotation of compound gear 110 causes head shaft 106 to rotate as well. Compound gear 110 is linked to motor 102 such that operation of motor 102 also rotates compound gear 110. Pinion gear 140 is disposed on a second end 109 (best shown in FIG. 5) of head shaft 106. Compound gear 110 is positioned adjacent geneva driver 120, which is positioned adjacent to geneva follower 130. Geneva driver 120 is rotatably about a shaft 121. Shaft 121 may be oriented substantially perpendicular to head shaft 106. Shaft 121 may be oriented substantially parallel to arm shaft 170. Arm shaft 170 is connected to geneva follower 130, such that rotation of geneva follower 130 also rotates arm shaft 170. As discussed above, rotation of arm shaft 170 also rotates friction disks 27, 37 of the friction clutches 25, 35. Body assembly 100 includes a head frame 150 positioned in a head section of doll 1 (shown in FIG. 1). Head frame 150 includes a rack 152 extending down and positioned adjacent to pinion gear 140. In some embodiments, rack 152 may be integral to head frame 150. In other embodiments, it may be rotationally coupled and uncoupled from other portions of head frame 150. Rack 152 includes teeth 157 extending from a first end 153 to a second end 154. Teeth 142 of pinion gear 140 mesh with teeth 157 of rack 152 and cause head frame 150 to pivot as pinion gear 140 is rotated.

Figure 4A:
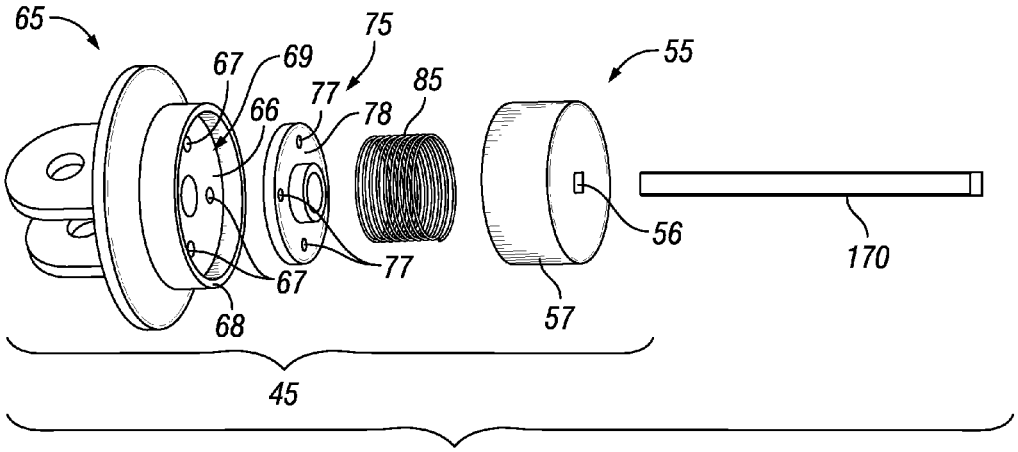
FIGS. 4A-4B show exploded perspective views of an embodiment of a friction spring clutch.
Figure 4B:
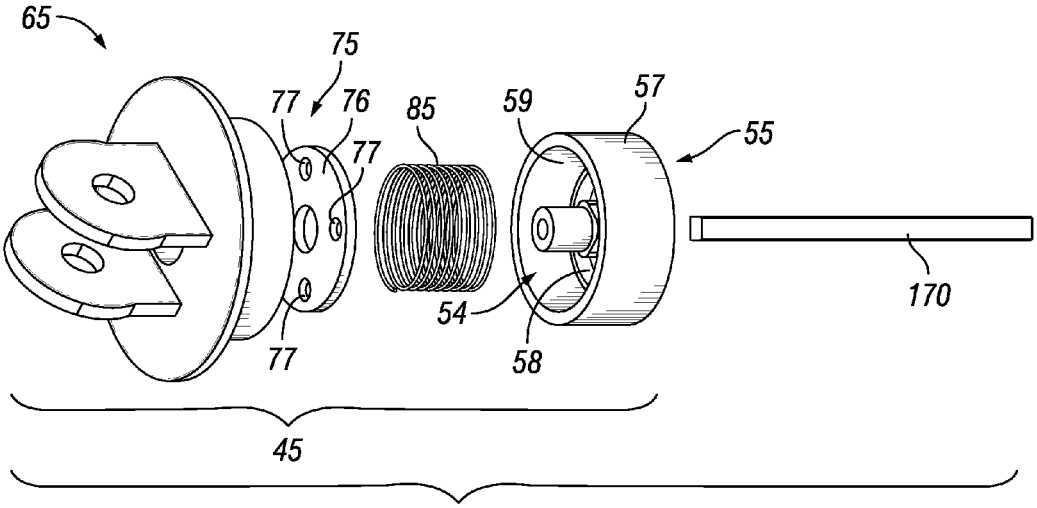

FIGS. 4A-4B show exploded perspective views of an embodiment of a friction spring clutch 45. In some embodiments, friction clutches 25, 35 (shown in FIG. 3) may each be a friction spring clutch 45, as would be appreciated by one of ordinary skill in the art having the benefit of this disclosure. Friction spring clutch 45 includes a base 55, an arm plate 65, a friction disk 75, and a spring 85. Friction disk 75 includes a first side 76, a second side 78, and a plurality of profiles 77. For example, profiles 77 may be countersunk holes as shown in FIG. 4A and FIG. 4B, but various other profiles may be used as would be appreciated by one of ordinary skill in the art having the benefit of this disclosure. Arm plate 65 includes a cavity or recess 69 defined by a base surface 66 and a side interior surface 68. Side interior surface 68 is shaped to receive an exterior surface 57 of base 55. Arm plate 65 includes profiles 67 positioned on base surface 66 shaped to receive profiles 77 of friction disk 75. Base 55 includes an aperture 56 shaped to receive an arm shaft 170 such that base 55 rotates with arm shaft 170. Base 55 also includes a cavity 54 defined by a base surface 58 and a side interior surface 59. Side interior surface 59 is shaped to receive friction disk 75.

When assembled, arm plate 65 is connected to or integral to an arm 20 or 30 of doll 1. Friction disk 75 is disposed within cavity 54 of base 55. Spring 85 is positioned within cavity 54 of base 55 and presses against both base surface 58 of base 55 and second side 78 of friction disk 75. First side 76 of friction disk 75 is positioned against base surface 66 of arm plate 65 such that profiles 67 of arm plate 65 engage profiles 77 of friction disk 75. Spring 85 provides a compressive force between arm plate 65 and friction disk 75. As arm shaft 170 rotates, it causes base 55 to rotate with arm shaft 170. Friction disk 75 rotates with base 55 and the compressive force between arm plate 65 and friction disk 75 transfers the rotational motion of friction disk 75 into arm plate 65. In operation, arm plate 65 may be subject to an outside force, such as a child moving the placement of an arm 20 or 30 connected to arm plate 65. The outside force applied to the arm 20 or 30 causes arm plate 65 to rotate with respect to friction disk 75, resulting in a rotational misalignment between profiles 67 of arm plate 65 engage profiles 77 of friction disk 75.

Stops (not shown) may limit the range of motion of arm plate 65. Friction disk 75 may be rotated until a stop is reached. Friction disk 75 continues to rotate as base surface 66 of arm plate 65 and first side 76 of friction disk 75 slide against each other. If friction disk 75 is rotated sufficient far toward the misaligned arm plate 65, profiles 67 of arm plate 65 may again engage profiles 77 of friction disk 75.

Figure 5:
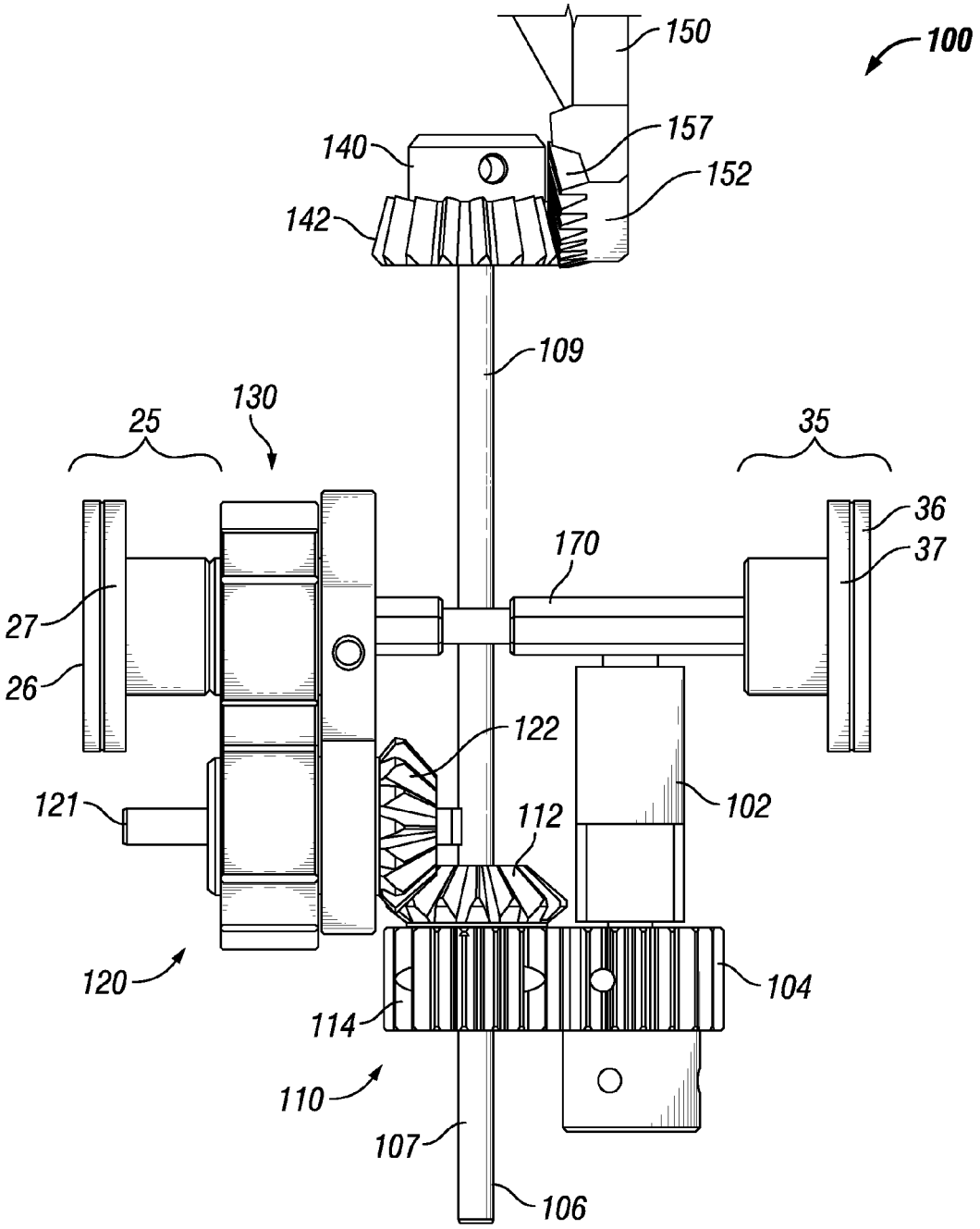
FIG. 5 shows a front view of the body assembly of FIG. 3.

FIG. 5 shows a front view of body assembly 100. Compound gear 110 is linked to motor 102 such that operation of motor 102 also rotates compound gear 110. As shown, compound gear 110 may include a spur gear 114 and a bevel gear 112. Motor 102 may be connected to a drive gear 104. Drive gear 104 includes teeth meshed with teeth of spur gear 114 of compound gear 110. Bevel portion 112 of compound gear 110 rotates with spur gear 114 of compound gear 110. As drive gear 104 rotates, compound gear 110 is caused to rotate in an opposite direction. In some embodiments, motor 102 may be connected directly to head shaft 106 and compound gear 110 may comprise only a bevel gear 112 connected to head shaft 106. In some embodiments, drive gear 104 may be a bevel gear and engaged directly with bevel gear 112 and spur gear 114 may be omitted. Head shaft 106 and compound gear 110 distribute the power from motor 102 into two drive paths.

In the first drive path, head shaft 106 rotates with compound gear 110, causing pinion gear 140 disposed on second end 109 of head shaft 106 to rotate at the same rate as compound gear 110. As pinion gear 140 rotates, its teeth 142 mesh with teeth 157 of rack 152 of head frame 150. Pinion gear 140 may be a bevel gear and rack 152 may be arc-shaped such that rotation of pinion gear 140 causes head frame 150 to pivot about a pivot point 160 (shown in FIGS. 7-9). The direction of rotation of motor 102 may be changed to cause head frame 150 to pivot up or down.

In the second drive path, bevel gear 112 of compound gear 110 rotates at the same rate as spur gear 114. Geneva driver 120 includes a bevel portion 122. Bevel portion 112 of the compound gear 110 includes teeth meshed with teeth of bevel portion 122 of geneva driver 120. The reduction ratio of bevel gear 112 of compound gear 110 to bevel portion 122 of geneva driver 120 may be 1:1. As the bevel gear 112 of compound gear 110 rotates, it drives bevel portion 122 of geneva driver 120 and geneva driver 120 rotates about shaft 121. As geneva driver 120 rotates, a portion of geneva driver 120 engages a portion of geneva follower 130, thereby causing geneva follower 130 to begin rotating in the opposite direction of geneva driver 120. Rotation of geneva follower 130 also rotates arm shaft 170 connected to geneva follower 130. Friction disk 27 of right friction clutch 25 and friction disk 37 of left friction clutch 35 are connected to arm shaft 170 at opposing ends and rotate with arm shaft 170. As discussed above, a compressive load between slide washer 26 and friction disk 27 may cause slide washer 26 to rotate with friction disk 27 and a compressive load between slide washer 36 and friction disk 37 may cause slide washer 36 to rotate with friction disk 37.

Figure 6A:
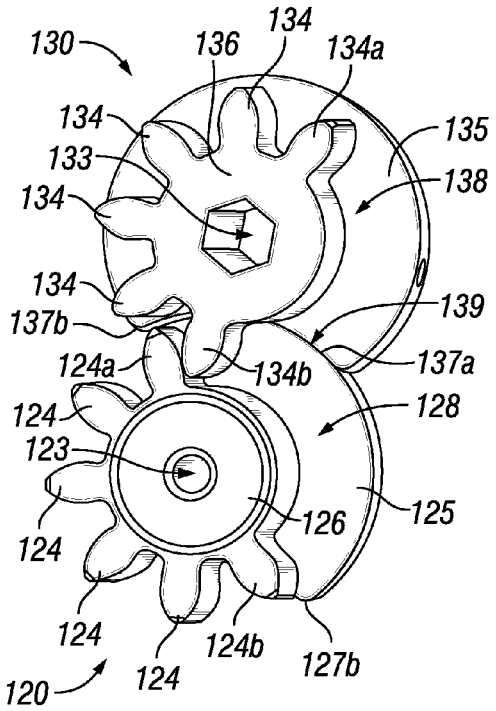
FIG. 6A shows a front perspective view of an embodiment of a geneva driver and a geneva follower in an intermediate position.
Figure 6B:
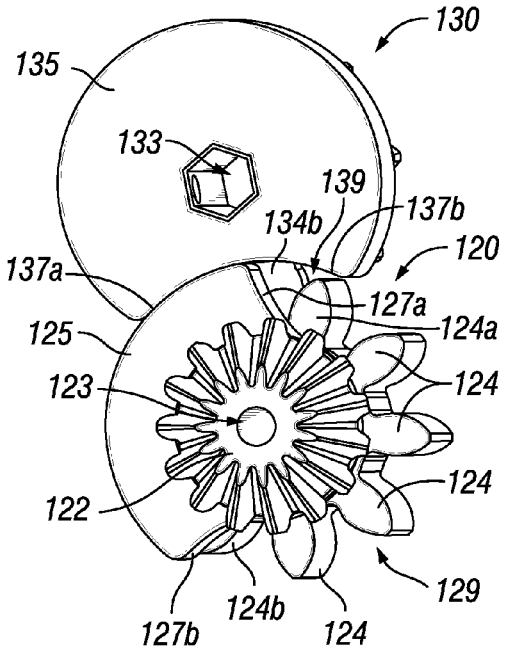
FIG. 6B shows a rear perspective view of the embodiment of FIG. 6A.
Figure 6C:
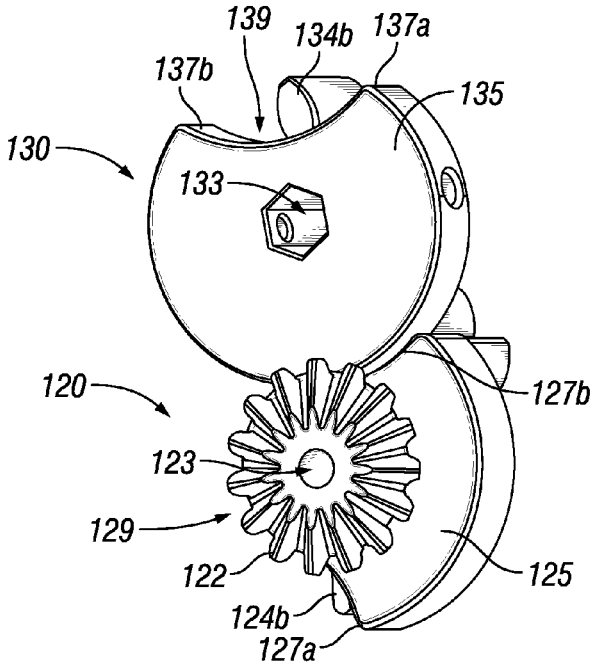
FIG. 6C shows a rear perspective view of the embodiment of FIG. 6A with the geneva driver fully rotated in one direction.

FIG. 6A shows a front perspective view of an embodiment of a geneva driver 120 and a geneva follower 130 in an intermediate position. FIG. 6B shows a rear perspective view of FIG. 6A. FIG. 6C shows a rear perspective view of geneva driver 120 and geneva follower 130 with geneva driver 120 fully rotated in one direction. Geneva driver 120 comprises a base 125 with a bevel portion 122 extending from one side of base 125 and a protrusion 126 extending opposite of base 125 from bevel portion 122. Bevel portion 122 is shaped to mesh with a bevel gear 112 of a compound gear 110 (shown in FIG. 4). Base 125 may be circular and include a cutout 129 to form a minor arc circular segment shape. Cutout 129 is shaped to receive a base 135 of geneva follower 130. Cutout 129 extends and arcs from a first edge 127*a* to a second edge 127*b* of base 125. Protrusion 126 includes teeth 124 extending radially from the perimeter of protrusion 126 around only a portion of the perimeter. Teeth 124 include a first end tooth 124*a* and a second end tooth 124*b*, with additional teeth 124 therebetween in one direction and a gap 128 therebetween in the other direction. An aperture 123 extends through geneva driver 120 and is shaped to receive a shaft 121 (shown in FIG. 4) and permit rotation thereon. In some embodiments, shaft 121 may be integral to geneva driver 120.

Geneva follower 130 comprises a base 135 with a protrusion 136 extending therefrom. Base 135 may be circular and includes a cutout 139 to form a crescent shape. Cutout 139 is shaped to receive base 125 of geneva driver 120. Cutout 139 extends and arcs from a first edge 137*a* to a second edge 137*b* of base 135. Protrusion 136 includes teeth 134 extending radially from the perimeter of protrusion 136 around only a portion of the perimeter. Teeth 134 include a first end tooth 134*a* and a second end tooth 134*b*, with additional teeth 134 therebetween in one direction and a gap 138 therebetween in the other direction. An aperture 133 extends through geneva follower 130 and is shaped to receive an arm shaft 170 (shown in FIG. 4) and rotate arm shaft 170 with geneva follower 130. By way of example, aperture 133 may be hexagonal and arm shaft 170 may be hexagonal. Geneva driver 120 and geneva follower 130 are adjacently positioned so that teeth 124 of geneva driver 120 may engage teeth 134 of geneva follower 130 depending on the rotational position of geneva driver 120. Teeth 134 of geneva follower 130 may mesh between teeth 124 of geneva driver 120. The radius of base 125 of geneva driver 120 may overlap with the radius of base 135 of geneva follower 130. Base 125 of geneva driver 120 may extend into cutout 139 of base 135 of geneva follower 130 or base 135 of geneva follower 130 may extend into cutout 129 of base 125 of geneva driver 120, depending on the orientation of geneva driver 120 with respect to geneva follower 130. Stated another way, geneva driver 120 rotates about an axis of rotation formed by shaft 121 (shown in FIG. 5) and geneva follower 130 rotates about an axis of rotation formed by arm shaft 170 (shown in FIG. 5). Base 125 of geneva driver 120 has a first radius from its axis of rotation (the first axis) to an outer edge. Base 135 of geneva follower has a second radius from its axis of rotation (the second axis) to an outer edge. The distance between the first axis of rotation and the second axis of rotation is less than the sum of the first radius and the second radius. A radius of curvature of cutout 139 of geneva follower 130 may be equal to the first radius. First edge 137*a* and second edge 137*b* of base 135 may be curved and each have a radius of curvature equal to the second radius.

FIGS. 6A and 6B show geneva follower 130 in its initial position. Cutout 139 of base 135 of geneva follower 130 is orientated towards geneva driver 120 so that the minor arc circular segment shaped base 125 of the geneva drive 120 may rotate without interference from crescent shaped base 135 of geneva follower 130. Geneva driver 120 is orientated such that second end tooth 134*b* of geneva follower 130 extends into gap 128 between first end tooth 124*a* and second end tooth 124*b* of geneva driver 120. As shown in FIGS. 6A and 6B, geneva driver 120 is in an intermediate position. Rotational motion will be describe with reference to FIG. 6A. Rotation of geneva driver 120 in a counterclockwise direction moves first end tooth 124*a* of geneva driver 120 away from second end tooth 134*b* of geneva follower 130. Geneva driver 120 rotates without causing geneva follower 130 to rotate and simultaneously head frame 150 (shown in FIGS. 7-9) pivots to simulate a nod, as will be apparent from the discussion herein. Rotation of geneva driver 120 in a clockwise direction moves first end tooth 124*a* of geneva driver 120 into engagement with second end tooth 134*b* of geneva follower 130. Teeth 124 of geneva driver 120 mesh with teeth 134 of geneva follower 130 to rotate geneva follower 130 in a counterclockwise direction. Referring now to FIG. 6B, as geneva driver 120 and geneva follower 130 rotate, first edge 127*a* of base 125 of geneva driver 120 is rotated away from second edge 137*b* of cutout 139 of geneva follower 130 as it advances through the rotation. The crescent shaped base 135 of geneva follower 130 is received within cutout 129 between first edge 127*a* and the second edge 127*b* of geneva driver 120. The rotation may be continued as base 125 of geneva driver 120 rotates out of cutout 139 of base 135 of geneva follower 130. A limit switch (not shown) may be used to prevent over-rotation of geneva driver 120 and geneva follower 130. FIG. 6C shows geneva driver 120 and geneva follower 130 after geneva driver 120 has been rotated to its maximum extent. Second edge 127*b* of base 125 of geneva driver 120 is positioned adjacent to base 135 of geneva follower 130 such that further rotation of geneva driver 120 is inhibited. It is appreciated that the angle between first edge 127*a* and second edge 127*b*, as well as the position and number of teeth 124 of geneva driver 120 and the position and number of teeth 134 of geneva follower 130 may affect the maximum extent of rotation, as well as the relative speed rotation.

Figure 7:
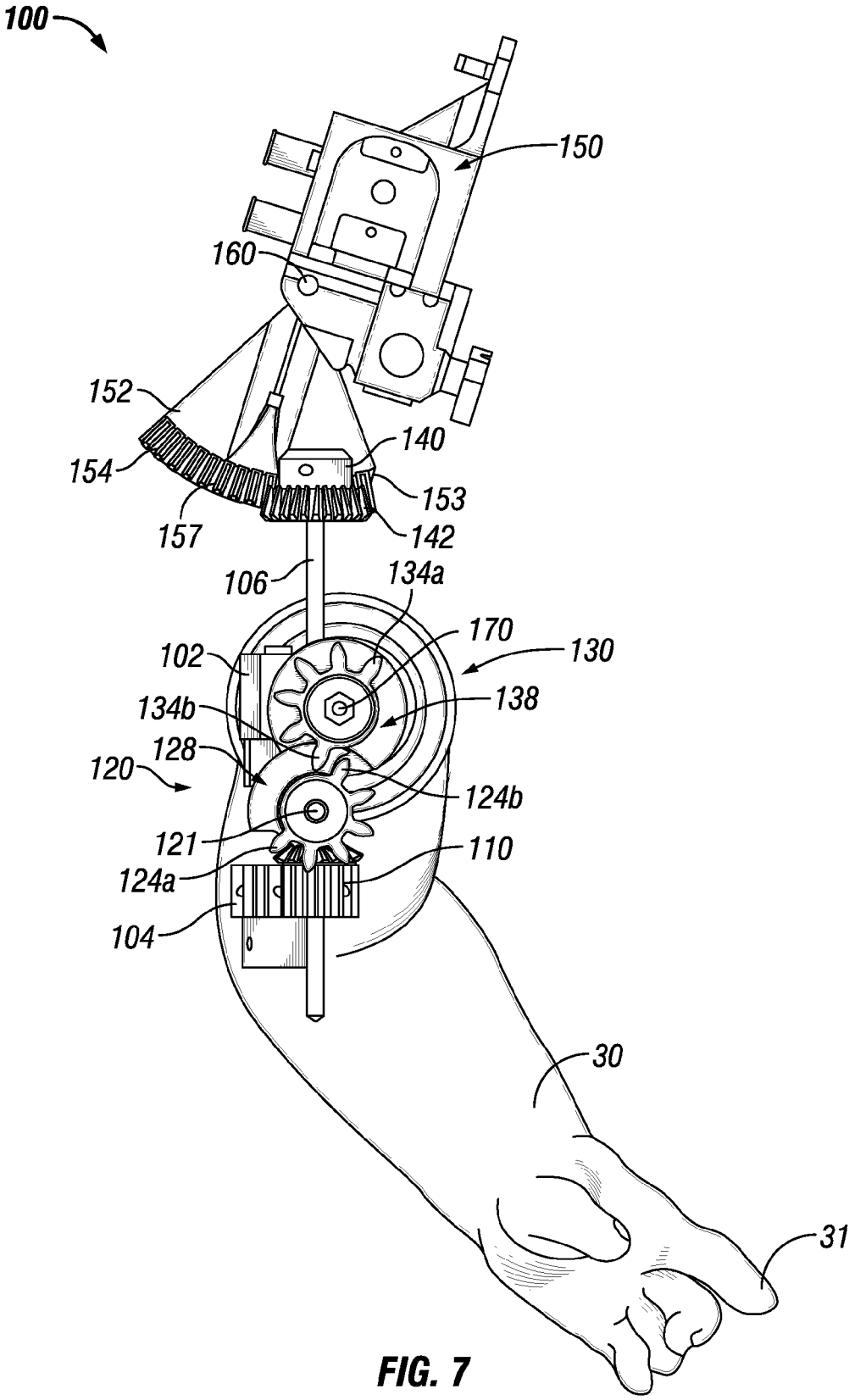
FIG. 7 shows a partial view of the embodiment of FIG. 3 in a lowered position.
Figure 8:
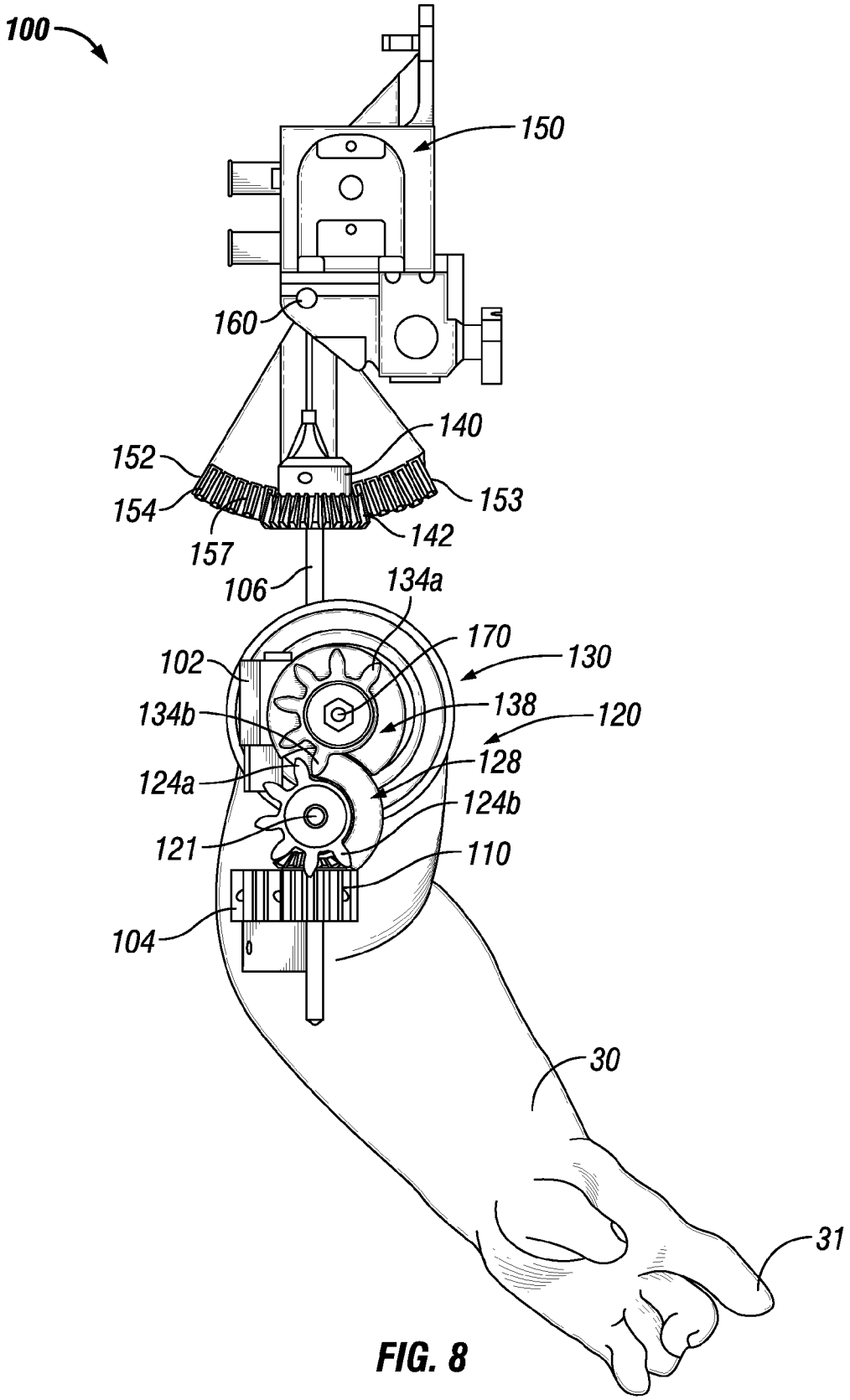
FIG. 8 shows the embodiment of FIG. 7 in an intermediate position.
Figure 9:
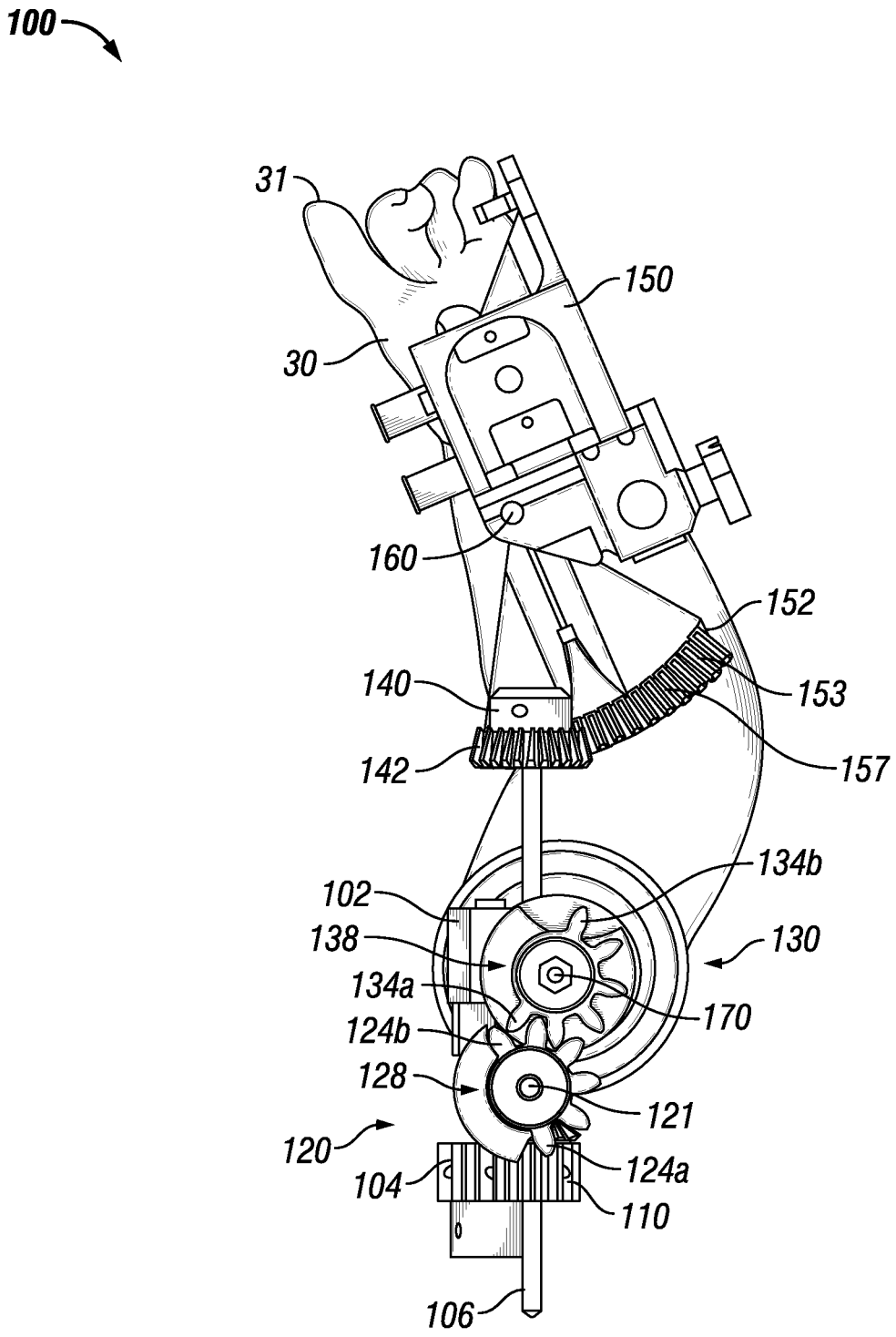
FIG. 9 shows the embodiment of FIG. 7 in a raised position.

FIGS. 7-9 show positions of geneva driver 120 and geneva follower 130 through the range of motion of body assembly 100. FIG. 7 shows body assembly 100 in a lowered position with head frame 150 in a nodded position and left arm 30 lowered such that a left hand 31 would be positioned in the lap of the doll. Geneva driver 120 is shown in a first position. Right arm 20 and right friction clutch 25 have been omitted for the purposes of illustration, but it is appreciated that movement of right arm 20 may be understood from the description below regarding left arm 30 and above with respect to right friction clutch 25. It is appreciated that left arm 30 may be positioned otherwise, as described with respect to left friction clutch 35 (best shown in FIG. 3). However, for the purpose of illustration in FIGS. 7-9, left arm 30 is shown in proper alignment. Pinion gear 140 is positioned at first end 153 of rack 152 of head frame 150. Head frame 150 is pivotally connected to neck carrier 210 at a pivot point 260 (shown in FIG. 10). In the lowered positioned, second end tooth 124*b* of geneva driver 120 extends into gap 138 between first end tooth 134*a* and second end tooth 134*b* of geneva follower 130 and second end tooth 134*b* of geneva follower 130 extends into gap 128 between first end tooth 124*a* and second end tooth 124*b* of geneva driver 120. Geneva driver 120 may be inhibited from further rotation in a clockwise direction by way of a stop or limit switch. Motor 102 is connected to drive gear 104 and causes compound gear 110 to rotate. In some embodiments, motor 102 may be directly connected to head shaft 106 and drive gear 104 may be omitted. As compound gear 110 rotates, pinion gear 140 is driven by head shaft 106 connected to compound gear 110. Teeth 142 of pinion gear 140 engage teeth 157 of rack 152 and advance, in a rearward direction, along rack 152 towards second end 154 of rack 152, thereby pivoting head frame 150 about pivot point 160. Additionally, as compound gear 110 rotates, geneva driver 120 is rotated in a clockwise direction about shaft 121. Because second end tooth 134*b* of geneva follower 130 is positioned within gap 128 of geneva driver 120 and second end tooth 124*b* of geneva driver 120 is positioned in gap 138 of geneva follower 130, the clockwise rotation of geneva driver 120 about shaft 121 does not cause geneva follower 130 to rotate initially. As geneva follower 130 remains stationary with respect to the rotating geneva driver 120, arm shaft 170 also remains stationary. Motor 102 is operated to pivot head frame 150 about pivot point 160 to an intermediate position, as shown in FIG. 8.

FIG. 8 shows body assembly 100 in an intermediate position with head frame 150 in a position between raised and nodded and with left arm 30 and hand 31 in the same position as FIG. 7. Geneva driver 120 has rotated clockwise a first extend from the first position shown in FIG. 7 to a second position. The first extent of rotation of geneva driver 120 may be approximately 120 degrees. Second end tooth 134 of geneva follower 130 is still positioned with gap 128 of geneva driver 120. First end tooth 124*a* of geneva driver 120 is now positioned adjacent to second end tooth 134*b* of geneva follower 130 such that additional clockwise rotation of geneva driver 120 will engage first end tooth 124*a* of geneva driver 120 with second end tooth 134*b* of geneva follower 130, causing geneva follower 130 to rotate. Pinion gear 140 is positioned between first end 153 and second end 154 of rack 152 of head frame 150. For example, head frame 150 may be pivotally positioned such that the doll is looking directly forward. Motor 102 may be operated further and continue to advance pinion gear 140 in a rearward direction along rack 152 towards second end 154 of rack 152 of head frame 150. Additionally, further operation of motor 102 continues to rotate geneva driver 120 in a clockwise direction. Teeth 124 of geneva driver 120 interact with teeth 134 of geneva follower 130 such that geneva follower 130 rotates in a counterclockwise direction. As geneva follower 130 rotates in the counterclockwise direction, arm shaft 170 rotates with geneva follower 130 and raises left arm 30.

FIG. 9 shows body assembly 100 in a raised position with head frame 150 raised and left arm 30 raised. Geneva driver 120 is shown in a third position and has been rotated a second extent between the second position shown in FIG. 8 and the third position. The second extent may be more than 120 degrees, such as 180 degrees. Geneva follower 130 has also been rotated. The extent of rotation of geneva follower 130 may be equal to the second extent of rotation of geneva driver 120. Hand 31 of left arm 30 may be positioned adjacent to the ear of the doll when body assembly 100 is in the raised positioned. Pinion gear 140 has been advanced rearward to second end 154 (shown in FIG. 8) of rack 152 of head frame 150 such that head frame 150 has pivoted about pivot point 160 and is in a raised position. Simultaneously, left arm 30 is raised with the rotation of geneva follower 130.

Referring to FIGS. 7-9 sequentially, in FIG. 7, head frame 150 of the doll is nodded with left arm 30 positioned in the doll's lap or to its side. As motor 102 is operated, left arm 30 remains in the lowered position but head frame 150 pivots about a pivot point 160 so that head frame 150 of the doll is partially raised, as shown in FIG. 8. Geneva driver 120 rotates as head frame 150 is raised, but geneva follower 130 remains stationary. As shown in FIG. 8, before head frame 150 is fully raised, geneva driver 120 engages geneva follower 130 and causes it to rotate as well. Once geneva follower 130 is engaged, further operation of motor 102 continues to raise head frame 150 while also rotating geneva follower 130 and thereby rotating friction disk 37 (shown in FIG. 3). As discussed above, a compressive load between friction disk 37 and slide washer 36 might cause left arm 30 to rotate. Motor 102 is operated until head frame 150 and left arm 30 are in a desired position, as shown in FIG. 9. The direction of motor 102 may be reversed to lower head frame 150 and left arm 30.

The gearing ratios may be selected to achieve the desired effect. For example, because head frame 150 is already positioned in an intermediate position before geneva follower 130 begin rotating, geneva follower 130 may be rotated more rapidly than head frame 150 is pivoted. Furthermore, the weight of head frame 150 (and mounted hardware) may require greater torque than needed to raise arms 20, 30 (shown in FIG. 3). The gearing ratio of pinion gear 140 to bevel gear 112 may be large, such as 15:1. In some embodiments, the gearing ratio of bevel portion 122 of geneva driver 120 to teeth 124 of geneva driver 120 may be adjusted, as would be appreciated by one of ordinary skill in the art having the benefit of this disclosure.

Figure 10:
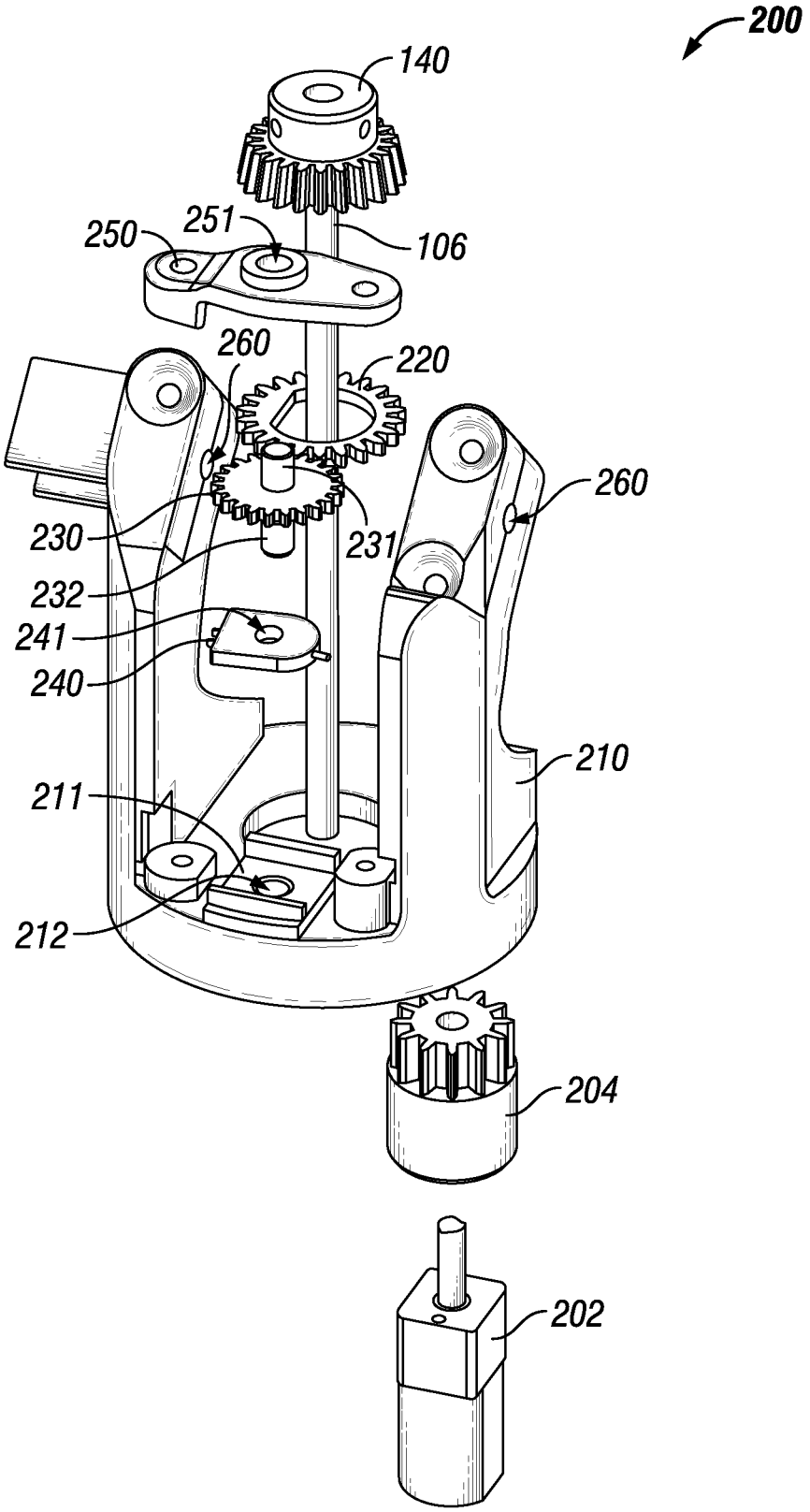
FIG. 10 shows an exploded perspective view of an embodiment of a neck assembly.
Figure 11:
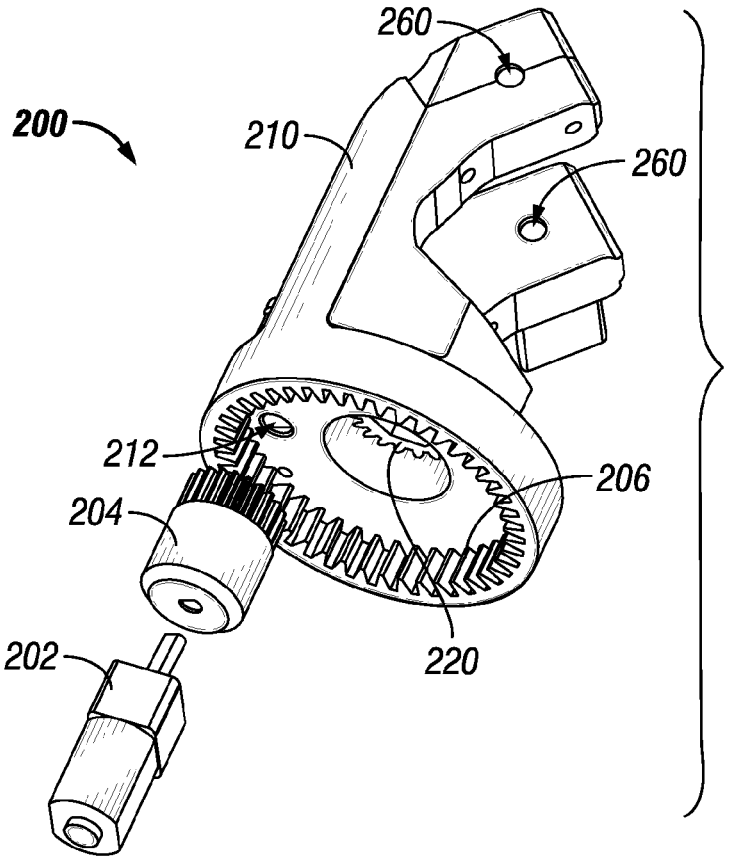
FIG. 11 shows a bottom perspective view of the embodiment of FIG. 10.

FIG. 10 shows an exploded view of an embodiment of a neck assembly 200. FIG. 11 shows a bottom perspective view of neck assembly 200. Neck assembly 200 includes a motor 202, a drive gear 204, and a neck carrier 210. Head shaft 106 and pinion gear 140 of body assembly 100 are shown for context. Neck carrier 210 includes pivot points 260 configured to connect with pivot points 160 of head frame 150 of body assembly 100 (shown in FIGS. 7-9). As shown in FIG. 11, neck carrier 210 includes a ring gear 206 positioned on a bottom portion of neck carrier 210. Drive gear 204 is positioned within ring gear 206. Motor 202 drives drive gear 204, which drives ring gear 206. Motor 202 is fixed within the doll such that operation of motor 202 rotates ring gear 206 about drive gear 204 causing neck carrier 210 to rotate and simulate side to side head movement of the doll. Motor 202 may be operated in a first direction to rotate neck carrier 210 to the left and may be operated in a reverse direction to rotate neck carrier 210 to the right.

Neck assembly 200 may include an a fixed gear 220, a tracing gear 230, a through hole potentiometer 240, and a cap 250. Neck carrier 210 may include a mount 211 configured to receive through hole potentiometer 240. Fixed gear 202 may be a fixed spur gear. Tracing gear 230 may be a spur gear and may include a first post 231 and a second post 232. Through hole potentiometer 240 may include an aperture 241 shaped to receive second post 232. Cap 250 may include an aperture 251 shaped to receive first post 231. Through hole potentiometer 240 is positioned within mount 211 of neck carrier 210. Second post 232 of tracing gear 230 extends through aperture 241 of through hole potentiometer 240 and into an aperture 212 of mount 211 of neck carrier 210. First post 231 of tracing gear 230 is positioned within aperture 251 of cap 250. Cap 250 is connected to neck carrier 210 such that tracing gear 230 may rotate between cap 250 and mount 211 of neck carrier 210. Tracing gear 230 is positioned adjacent to fixed gear 220 with their teeth meshing. In operation, as neck carrier 210 rotates, fixed gear 220 remains static. Tracing gear 230 is carried on neck carrier 210 and rotates with respect to fixed gear 220. As the tracking gear 230 rotates, second post 232 of tracing gear 230 rotates within aperture 241 of through hole potentiometer 240. Through hole potentiometer 240 communicates the rotation of tracing gear 230 to a control unit to determine the relative rotational position of neck carrier 210.

Figure 12:
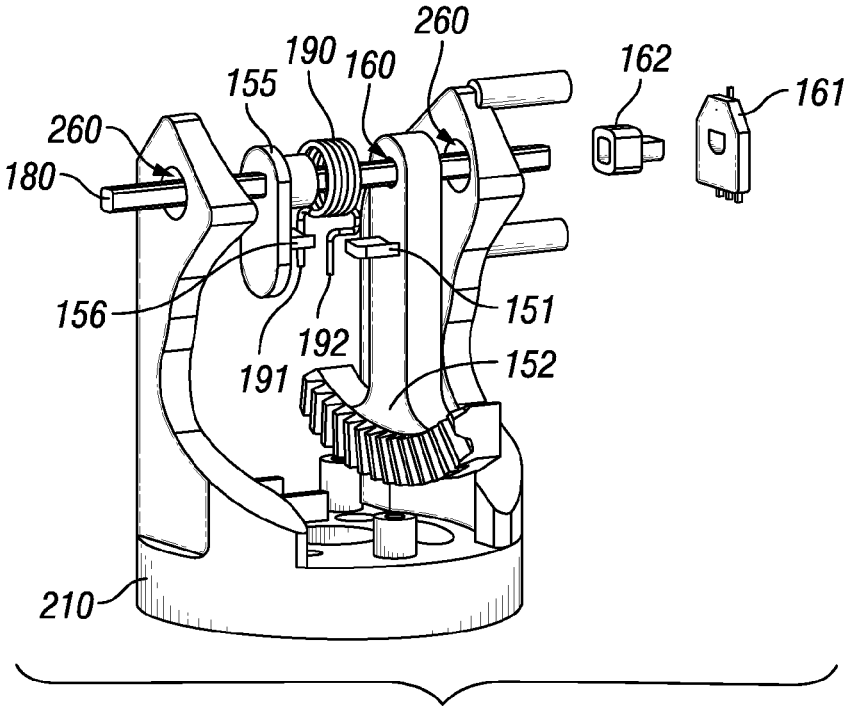
FIG. 12 shows an exploded view of an embodiment of a neck carrier connected to an embodiment of a rack of a head frame.

FIG. 12 shows an exploded view of an embodiment of a neck carrier 210 connected to an embodiment of a rack 152 of a head frame. As shown in FIG. 12, rack 152 may be rotationally coupled and uncoupled from other portions of the head frame. Pivot point 160 may be positioned within rack 152. A shaft 180 may extend through pivot point 260 of neck carrier 210 and through pivot point 160 of rack 152. Rack 152 is pivotable about the shaft 180. A head portion 155 is connected to shaft 180 such that head portion 155 rotates with shaft 180 and transfers movement into the rest of the head frame. A torsion spring 190 has a first end 191 and a second end 192. Rack 152 includes a lip 151. Head portion 155 includes lip 156. As rack 152 rotates about pivot point 160, lip 151 presses against an end 191, 192 of torsion spring 190. Lip 156 of head portion 155 also contacts torsion spring 190 and is rotated as rack 152 moves torsion spring 190. Thus, the rotational motion of rack 152 is coupled to head portion 155 through torsion spring 190. If an outside force is applied, such as a child moving the placement of head portion 150 with connected head portion 155, then torsion spring 190 may decouple rotation of head portion 155 from rack 152. For example, the outside force may cause head portion 155 to rotate and thereby rotate shaft 180 as well. Shaft 180 rotates within pivot point 160 of rack 152. Lip 156 of head portion 155 presses against second end 192 of torsion spring 190 and first end 191 presses against lip 151 of rack 152. However, rack 152 is inhibited from rotating through its connection to pinion gear 140 (shown in FIG. 3). Therefore, second end 192 of torsion spring 190 is moved away from first end 191 of torsion spring 190 and the resistance of torsion spring 190 is increased. Thus, rotational movement of head portion 155 about shaft 180 may be achieved without rotational motion of rack 152 about shaft 180. Through hole potentiometer 161 may measure the relative rotational position of shaft 180, and thereby rotation displacement of head portion 155 of the head frame about pivot point 160. An adapter 162 may be used to connect shaft 180 to through hole potentiometer 161.

Figure 13:
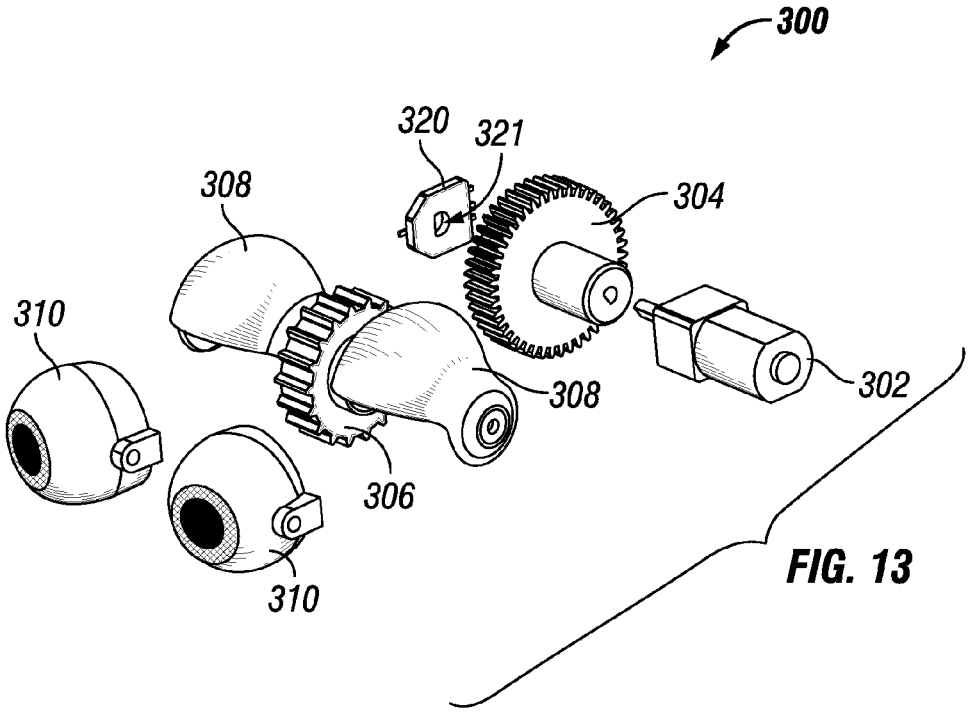
FIG. 13 shows a partially exploded perspective view of an embodiment of an eye assembly.

FIG. 13 shown an exploded view of an embodiment of an eye assembly 300. Eye assembly 300 is mounted to head frame 150 of body assembly 100 (shown in FIG. 2). Eye assembly 300 includes a motor 302, a drive gear 304, an eyelid gear 306, eyelids 308, and eyeballs 310. Eye assembly 300 may also include a through hole potentiometer 320. Through hole potentiometer 320 includes an aperture 321 that receives a portion of one of drive gear 304 or eyelids 308 and communicates rotational information to a control unit to determine the relative rotational position of eyelids 308. Drive gear 304 is connected to motor 302. Drive gear 304 is positioned adjacent to eyelid gear 306, such that rotation of drive gear 304 also rotates eyelid gear 306. Eyelids 308 are connected to eyelid gear 306 such that rotation of eyelid gear 306 rotates the eyelids as well. Eyelid gear 306 may be fixed to eyelids 308. In some embodiments, eye assembly 300 may include at least one friction clutch (not shown) connecting eyelids 308 with eyelid gear 306 so that an outside force, such as a child moving eyelids 308, will not cause misalignment between drive gear 304 and eyelid gear 306. Rotation of eyelid gear 306 may be used to realign eyelids 308 with eyelid gear 306. In operation, motor 302 drives drive gear 304, which in turn rotates eyelid gear 306 in an opposite direction. Eyelids 308 are pivotally mounted such that eyelids 308 may be pivoted between open and closed positions. In the closed position, eyelids 308 are rotated to cover the front of eyeballs 310. In the open position, eyelids 308 are rotated so that the front of eyeballs 310 are exposed.

Figure 14:
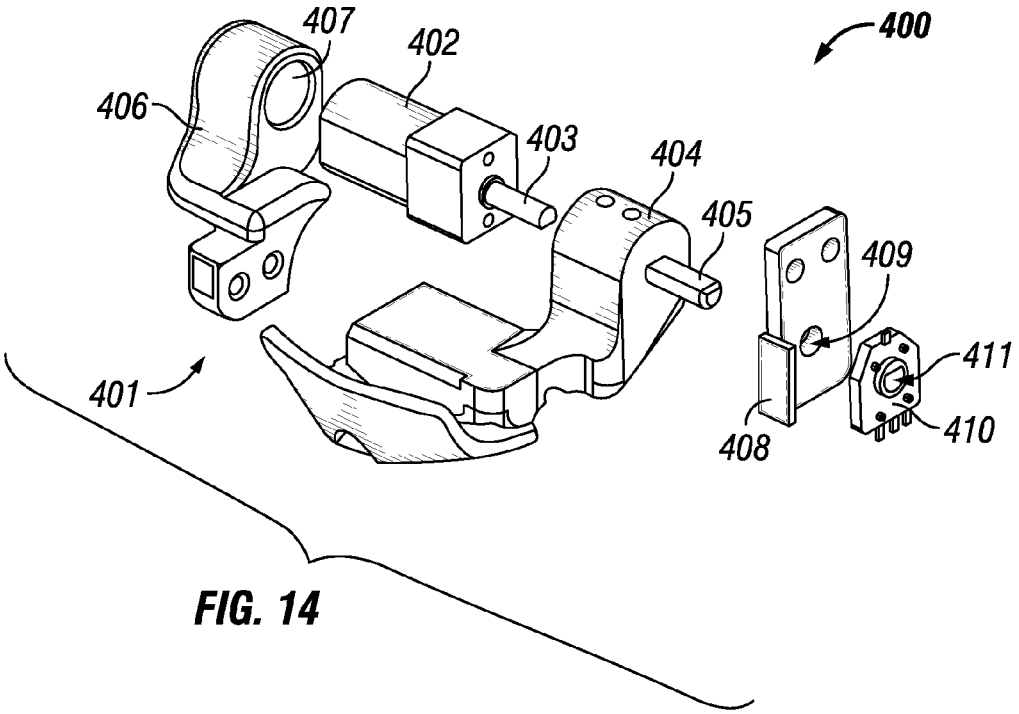
FIG. 14 shows an exploded perspective view of an embodiment of a mouth assembly.

FIG. 14 shows an exploded view of an embodiment of a mouth assembly 400. Mouth assembly 400 includes a motor 402 and a jaw 401. Jaw 401 may comprise multiple pieces, such as a left jaw portion 404 and a right jaw portion 406, to facilitate assembly of mouth assembly 400 upon head frame 150 of body assembly 100 (shown in FIG. 2). Motor 402 includes a drive shaft 403 configured to connect to the jaw 401 such that rotation of motor 402 also rotates the jaw 401. Jaw 401 may include a protrusion 405. A plate 408 may be mounted to head frame 150 (shown in FIG. 2) and include an aperture 409 shaped to receive the protrusion 405 of jaw 401. A through hole potentiometer 410 may be positioned adjacent to aperture 409 of plate 408 such that the protrusion 405 of the jaw 401 extends through an aperture 411 of through hole potentiometer 410 as well. Through hole potentiometer 410 communicates rotational information of jaw 404 to a control unit to determine the relative rotational position of jaw 401. Jaw 401 may include a mounting aperture 407 positioned on a side of jaw 401 and shaped to receive a protrusion (not shown) of head frame 150. Mouth assembly 400 is mounted to head frame 150 of body assembly 100 (shown in FIG. 2). The protrusion of head frame 150 extends into mounting aperture 407 of jaw 401 and the protrusion 405 of jaw 401 extends through plate 408 to pivotally support the jaw 401 upon head frame 150.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. An animatronic doll, the doll comprising:
a head frame having a rack;
a neck carrier, the head frame being pivotally mounted to the neck carrier;
a head shaft having a first end and a second end, the second end being closer to the head frame than the first end;
a bevel gear connected to the head shaft;
a pinion gear connected to the head shaft at the second end, the pinion gear being engaged with the rack of the head frame;
a first gear being rotatably mounted about a first axis of rotation, the first gear having a driver portion and a bevel portion, the bevel portion of the first gear being engaged with the bevel gear, the first gear having a first position, a second position, and a third position;
a second gear being rotatably mounted about a second axis of rotation, the second gear having a follower portion, wherein rotation of the first gear between the first position and the second position does not rotate the second gear and, wherein rotation of the first gear between the second position and the third position rotates the second gear; and
a motor, configured to rotationally drive the bevel gear and the head shaft.

2. The doll of claim 1, further comprising a torsion spring connecting the rack to a portion of the head frame.

3. The doll of claim 1, further comprising:
a drive gear connected to the motor; and
a compound gear comprised of the bevel gear and a spur gear, the spur gear being engaged with the drive gear.

4. The doll of claim 1, wherein the driver portion of the first gear further comprises:
a base, the bevel portion being disposed on a side of the base;
a protrusion extending from the base opposite the bevel portion; and
a plurality of teeth extending radially from the protrusion, the plurality of teeth including a first end tooth and a second end tooth with a gap therebetween; and
wherein the follower portion of the second gear further comprises:
a base;
a protrusion extending from the base; and
a plurality of teeth extending radially from the protrusion, the plurality of teeth including a first end tooth and a second end tooth with a gap therebetween.

5. The doll of claim 4, wherein the base of the first gear has a first radius from the first axis of rotation and wherein the base of the second gear has a second radius from the second axis of rotation, the distance between the first axis of rotation and the second axis of rotation being less than the sum of the first radius and the second radius.

6. The doll of claim 5, wherein the base of the second gear includes a cutout having a radius equal to the first radius.

7. The doll of claim 5, wherein the base of the second gear is crescent shaped.

8. The doll of claim 7, further comprising:
an arm shaft having a first end and a second end, the second gear being connected to the arm shaft between the first end and the second end;
a left friction clutch having a friction disk and a slide washer, the friction disk of the left friction clutch being connected to the first end of the arm shaft;
a right friction clutch having a friction disk and a slide washer, the friction disk of the right friction clutch being connected to the second end of the arm shaft;
a left arm connected to the slide washer of the left friction clutch; and
a right arm connected to the slide washer of the right friction clutch.

9. The doll of claim 8, wherein the neck carrier further comprises a ring gear disposed on a bottom of the neck carrier, the doll further comprising a neck motor connected to a neck drive gear, wherein rotation of the neck drive gear rotates the neck carrier.

10. A method of operating an animatronic doll, the method comprising:
actuating a motor to rotate a compound gear, the compound gear including at least a bevel gear;
rotating a head shaft connected to the compound gear;
rotating a pinion gear connected to the head shaft;
pivoting a head frame having a rack, the rack engaging the rotating pinion gear;
rotating a first gear a first extent from a first position to a second position, the first gear including a bevel portion engaged with the bevel gear, the first gear including a driver portion positioned adjacent a follower portion of a second gear, wherein the driver portion does not engage the follower portion of a second gear during the first extent of rotation; and rotating the first gear a second extent from the second position to a third position, wherein the driver portion engages the follower portion of a second gear during the second extent of rotation and rotates the follower portion of the second gear.

11. The method of claim 10, wherein the head frame pivots at a slower rate than the follower portion of the second gear during the second extent of rotation.

12. The method of claim 11, wherein the second gear is connected to an arm shaft such that the arm shaft rotates with the second gear, the arm shaft being connected to a right arm and a left arm.

13. The method of claim 11, wherein the rack is connected to a portion of the head frame through a torsion spring.

14. The method of claim 11, wherein the motor includes a drive gear and the compound gear includes a spur gear, the drive gear engaging the spur gear of the compound gear, wherein the head shaft is rotated through its connection to the compound gear.

15. The method of claim 11, wherein the second extent of rotation is more than 120 degrees.

16. An animatronic doll, the doll comprising:

a head frame having a rack;

a neck carrier, the head frame being pivotally mounted to the neck carrier;

a bevel gear connected to a head shaft;

a first gear configured to be driven by the bevel gear, the first gear being rotatable between a first position, a second position, and a third position; and a second gear positioned adjacent the first gear, the first gear driving the second gear when the first gear is rotated between the second position and the third position, wherein rotation of the head shaft rotates a pinion gear engaged with the rack of the head frame and wherein rotation of the bevel gear rotates the first gear.

17. The doll of claim 16, wherein the extent of rotation between the second position and the third position is more than 120 degrees.

18. The doll of claim 16, wherein the first gear further comprises:

a base;

a protrusion extending from the base; and a plurality of teeth extending radially from the protrusion, the plurality of teeth including a first end tooth and a second end tooth with a gap therebetween; and wherein the second gear further comprises:

a base;

a protrusion extending from the base; and a plurality of teeth extending radially from the protrusion, the plurality of teeth including a first end tooth and a second end tooth with a gap therebetween.

19. The doll of claim 18, further comprising:

an arm shaft having a first end and a second end, the second gear being connected to the arm shaft between the first end and the second end;

a left friction clutch having a friction disk and a slide washer, the friction disk of the left friction clutch being connected to the first end of the arm shaft;

a right friction clutch having a friction disk and a slide washer, the friction disk of the right friction clutch being connected to the second end of the arm shaft;

a left arm connected to the slide washer of the left friction clutch; and a right arm connected to the slide washer of the right friction clutch.

20. The doll of claim 19, wherein the neck carrier further comprises a ring gear disposed on a bottom of the neck carrier, the doll further comprising a neck motor connected to a neck drive gear, wherein rotation of the neck drive gear rotates the neck carrier.

* * * * *